United States Patent [19]

Picchietti, Sr.

[11] Patent Number: 4,567,618

[45] Date of Patent: Feb. 4, 1986

[54] MACHINE FOR CLEANING BOWLING BALLS AND SHOES

[75] Inventor: Remo N. Picchietti, Sr., Bannockburn, Ill.

[73] Assignee: DBA Products Company, Inc., Lake Bluff, Ill.

[21] Appl. No.: 615,520

[22] Filed: May 30, 1984

[51] Int. Cl.[4] ..... A47L 23/22; A63B 47/04

[52] U.S. Cl. ..... 15/4; 15/21 A; 15/36; 15/97 R

[58] Field of Search ..... 15/4, 21 A, 36, 37, 15/97 R, 97 A

[56] References Cited

U.S. PATENT DOCUMENTS

| | | | |
|---|---|---|---|
| D. 199,238 | 9/1964 | Harkins | D9/2 |
| D. 268,706 | 4/1983 | Muller et al. | D32/1 |
| 2,321,162 | 6/1943 | Sohm | 15/21 A |
| 2,469,948 | 5/1949 | Bune | 15/21 A |
| 3,103,677 | 9/1963 | Gallant | 15/21 A |
| 3,150,392 | 9/1963 | Molander | 15/4 |
| 4,190,919 | 3/1980 | Burford | 15/4 |
| 4,432,112 | 2/1984 | Muller | 15/36 |

*Primary Examiner*—Edward L. Roberts

*Attorney, Agent, or Firm*—Neuman, Williams, Anderson & Olson

[57] ABSTRACT

A machine is provided for cleaning and polishing a bowling ball and for removing dirt and debris from the soles of shoes. The machine includes: a ball cleaning and polishing apparatus adapted for receiving a bowling ball at the top of the machine; a shoe cleaning apparatus in the lower front of the machine for cleaning the soles of shoes of the user while the ball cleaning mechanism cleans the ball; and interrelating controls that regulate the operation of the cleaning apparatus. The controls activate the ball cleaning apparatus when the user has inserted the appropriate coin or coins in the machine and has completely enclosed the ball in the machine's housing. They will activate the shoe cleaning apparatus only when the ball cleaning mechanism is activated and while the user holds a spring loaded switch closed. A display structure is included for displaying educational or advertising material to the user while he or she use the cleaning apparatus.

12 Claims, 9 Drawing Figures

FIG. 1
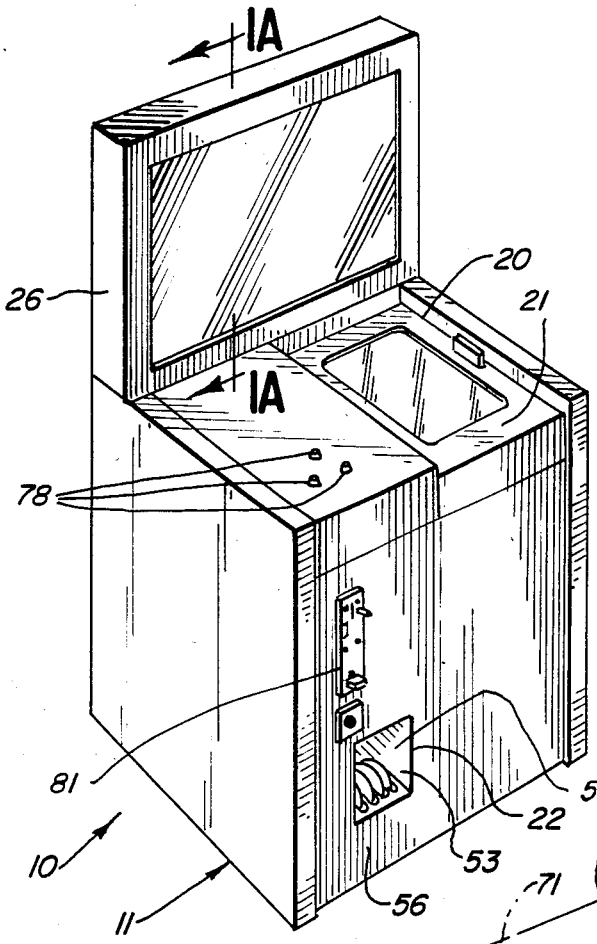
FIG. 3
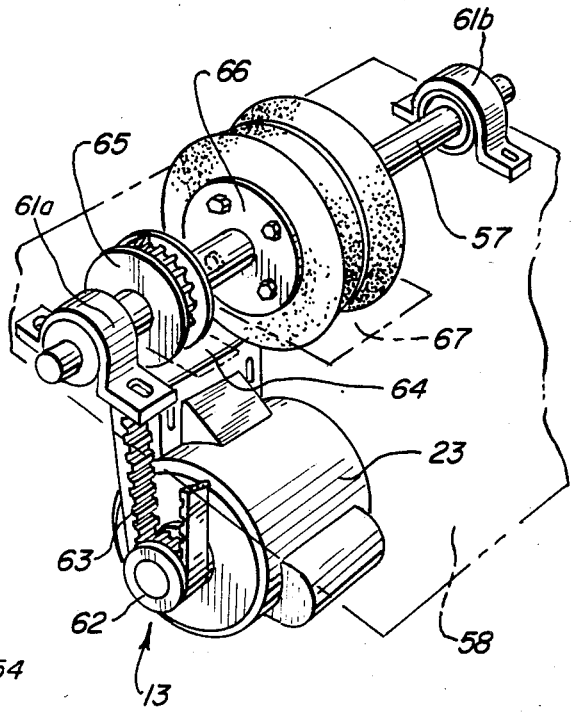
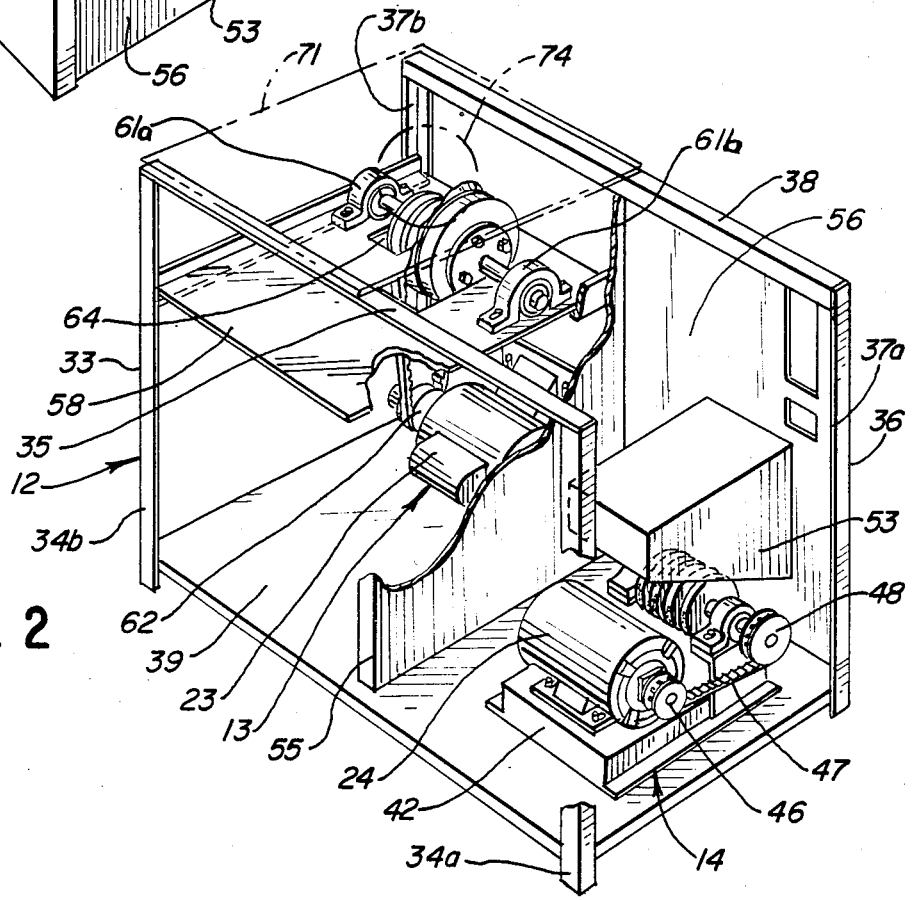
FIG. 2

FIG. 1A
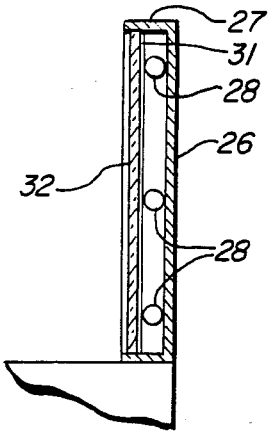
FIG. 2A
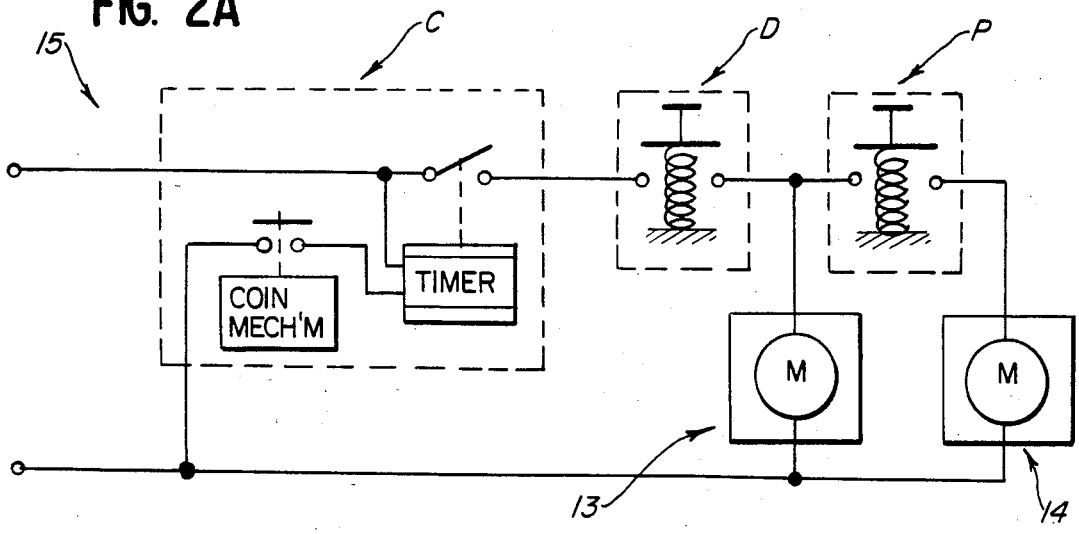
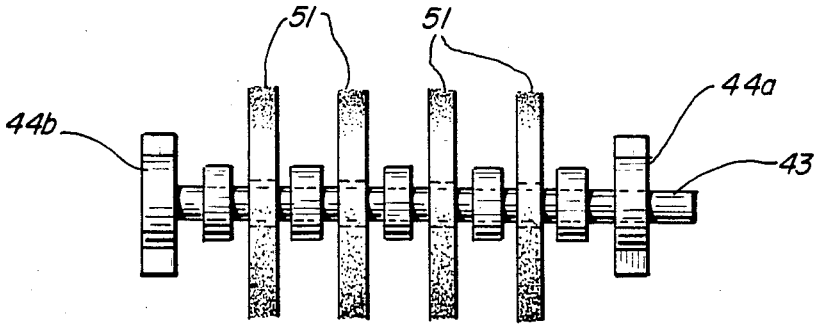
FIG. 4A

MACHINE FOR CLEANING BOWLING BALLS AND SHOES

BACKGROUND OF THE INVENTION

1. Field of the Invention

The present invention relates to a machine for cleaning bowling balls and shoes. More particularly, this invention relates to an improved machine which cleans the soles of the user's shoes while it simultaneously cleans and polishes the user's bowling ball.

2. Description of the Prior Art

Ball control is important in bowling as it is in many other sports. Ball control requires proper arm and body motion and wrist action to roll the ball in the desired path down the alley and towards the pins. In placing the ball in the desired path, a bowler will usually slide to the foul line in a smooth, fluid motion and release the ball. The bowler's shoes play a major role in allowing the bowler to slide and release the ball with this smooth, fluid motion; but the bowler must keep the soles of his shoes free of dirt, debris or any sticky substances that may cause the shoes to stick to the floor and disrupt the delivery.

As a preventive measure, some bowlers sprinkle powder on the soles of their shoes; but the powder may make the shoes too slippery. Others bowlers use a shoe cleaning device to remove the debris and other foreign substances from the soles of their shoes. U.S. Pat. No. 4,190,919 issued Mar. 4, 1980 to Burford discloses such a device. The Burford device has a motor with an elongated shaft which rotates a flexible nylon brush and a rubber wheel. The nylon brush is used for cleaning leather soles and heels while the rubber wheel is used for cleaning rubber soles and heels.

To insure that the ball will move properly along the desired path after release, the bowler must also remove any dirt, debris and sticky substances from its surface. To clean the ball, the bowler may use a hand held brush and a cloth to polish it. However, due to the size and weight of the bowling ball, the bowler will usually use an automatic ball cleaning apparatus such as the apparatus disclosed in U.S. Pat. No. 3,150,392 issued Sept. 29, 1964 to Molander. The Molander apparatus includes a housing, an electric motor and a number of brushing, cleaning and polishing elements.

As stated above, both clean shoe soles and a clean ball are desirable in bowling. Thus, it is desirable to provide for both shoe cleaning and ball cleaning in a bowling establishment. These services should be available to the customer at low cost, maximum convenience and attractiveness, preferably by automated equipment which may be coin-operated by the customer. Such equipment should be compact, requiring a minimum amount of space. The customer should expend little or no effort and a minimum amount of time to obtain the services from the equipment. The equipment may conveniently display advertising and/or educational material for perusal by the user or passersby. Moreover, the equipment should be simple to operate, with safety features that protect the user and other people around the machine, and should be of simple construction, durable and easy to maintain.

OBJECTS OF THE INVENTION

It is an object of this invention to provide an improved machine which satisfies the aforestated requirements.

It is an object of this invention to provide a simple machine that cleans both bowling balls and shoes.

It is a more specific object of the present invention to provide a simple, reliable and compact machine which simultaneously cleans and polishes a bowling ball and which cleans bowling shoes by brushing off embedded debris or other foreign substances from their soles.

Other objects, advantages and features of the present invention will become apparent upon reading the following detailed description and appended claims, and upon reference to the accompanying drawings.

SUMMARY OF THE INVENTION

In accordance with the preferred embodiment of this invention, a machine is provided which achieves the foregoing objects. The machine is a unified combination of a ball cleaning mechanism and a shoe cleaning mechanism arranged for convenient simultaneous use by a user, with interrelating controls that integrate the operation of the mechanism.

The machine includes a housing having an opening at the top for conveniently receiving a bowling ball of a user while the user stands adjacent the housing. Through this opening, the user places the ball in a power operated ball cleaning mechanism disposed in the housing next to the opening. This mechanism receives and cleans the bowling ball. A power operated shoe cleaning mechanism disposed within a lower portion of the housing cleans the soles of the users shoes as the user stands next to the housing while the ball cleaning mechanism cleans the ball. The shoe cleaning mechanism is accessible to the user through a second opening in the housing. A power supply regulated by interrelating controls drives the shoe and ball cleaning mechanism. The interrelating controls include a first switch which the user must close for the power supply to deliver power to the ball cleaning mechanism and a second switch which the user must close after closing the first switch for the power supply to deliver power to the shoe cleaning mechanism.

BRIEF DESCRIPTION OF THE DRAWINGS

For a more complete understanding of this invention one may refer to the embodiment illustrated in greater detail in the accompanying drawings and described below by way of an example of the invention. In the drawings:

FIG. 1 is a perspective view of a preferred embodiment of the bowling ball and shoe cleaning machine of this invention.

FIG. 1A is a sectional view taken along line 1A—1A of FIG. 1.

FIG. 2 is a perspective view showing the frame and internal mechanisms of the machine of FIG. 1.

FIG. 2A is a schematic view of the power circuit and controls of the machine of FIG. 1.

FIG. 3 is a perspective view of the ball cleaning and polishing mechanism of the machine of FIG. 1.

FIG. 4A is a plan view of the brush shaft of the cleaning mechanism of FIG. 4.

Figure 4:
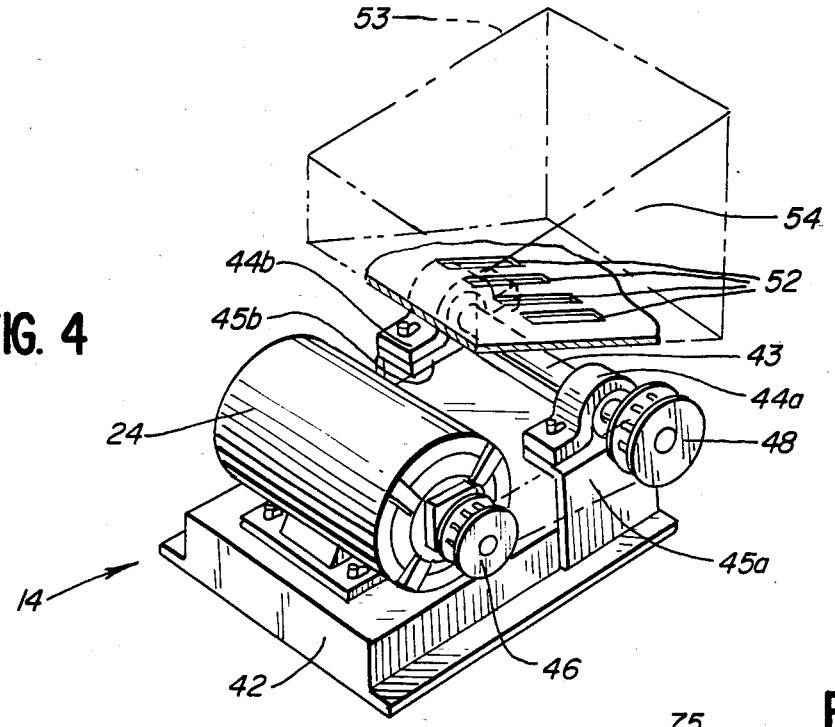
FIG. 4 is a perspective view of the shoe cleaning mechanism of the machine of FIG. 1.

While the invention will be described in connection with a preferred embodiment, it will be understood that it is not limited to this embodiment.

DETAILED DESCRIPTION OF THE DRAWINGS AND A PREFERRED EMBODIMENT

Turning now to the drawings, FIGS. 1 and 2 show the preferred embodiment of a machine 10 for cleaning bowling balls and shoes. The machine 10 generally comprises a cabinet 11, an internal support frame 12, a power-operated ball cleaning apparatus 13, a power-operated shoe cleaning apparatus 14, and a power circuit with interrelating controls 15 (See FIG. 2A).

The cabinet 11 and a closeable top opening 20 (See also FIG. 5) at approximately waist height through which the user inserts a bowling ball into a power-operated ball cleaning and/or polishing apparatus 13 disposed in the cabinet 11 adjacent that opening. This top opening 20 is closeable by a sliding door 21 which the user must place in the closed position for the ball cleaning apparatus to operate.

When placing the ball into the machine 10 and/or removing it, the user normally will stand at the front of the machine. In the lower front portion of the cabinet 11, an opening 22 is provided into which a user can conveniently insert his or her foot. The shoe cleaning apparatus 14 is located adjacent this opening for cleaning the sole of a shoe on that foot while the machine 10 cleans the ball. Thus, the machine 10 performs both cleaning tasks simultaneously at the convenience of the operator in the course of the time and while at the position properly assumed during the cleaning of the ball. In addition to the convenience and time saving, the shoe cleaner encourages the user to remain at the machine during the ball cleaning operation and, therefore, to attend to the machine rather than to leave the machine while it is running and thereafter to have the cleaned ball remaining in an unattended machine when the next user seeks to use that machine.

The location of the opening 22 is at the left hand side of the cabinet for greatest convenience in cleaning the sole of the left shoe which is the primary sliding shoe for most bowlers. However, the opening 22 could be placed in a center or right-hand portion of the cabinet 11; or a multiple of openings could be provided with similar cleaning devices in each; or one provided with a cleaning device especially adapted for cleaning leather soles and another with a cleaning device for cleaning rubber soles.

Referring also to FIG. 2A, the cleaning apparatus 13 and 14 are separately driven by two electrical motors 23 and 24, respectively. The power circuit 15 leads first to drive motor 23 of the ball cleaning mechanism 13. A conventional coin-operated timer switch C controls this circuit to actuate the ball cleaner automatically for a predetermined period of time upon the insertion of an appropriate token, coin or coins. However, for safety purposes this circuit includes a door activated switch D. The switch D is spring-loaded to the open position, and it is adapted to close when the user moves the door 21 to the closed position. This insures that the motor 23 will not operate unless the door 21 completely covers opening 20.

The motor 24 of the shoe cleaning apparatus 14 is connected in parallel with the motor 23 and in series with the switches C and D, whereby it can operate only while the ball cleaner operates. Moreover, the power circuit 15 includes a push switch P which is spring loaded to the open position and must be held closed by a user. Therefore, the shoe cleaning apparatus 14 operates only when the user has paid the appropriate fee and only while the user is present to hold the switch P closed. This feature and the safety switch arrangement on door 21 guard against unauthorized persons reaching into the moving ball cleaning mechanism 13. It also minimizes any risk of children reaching into an operating but unattended shoe cleaner 14.

In order to make further use of the user's time at the machine 10, the machine 10 includes a display fixture 26 secured to the top of the cabinet 11 and adapted to display advertising and/or educational material for viewing, particularly by the user while using the cleaning apparatus, as well as by bystanders and passersby. It is contemplated that this display wll be particularly useful for bowling instructions or views, or for advertising of related products. The fixture 26 comprises a housing 27 containing a light source comprising multiple fluorescent light tubes 28 and a transparency 31 which the light source illuminates by back-lighting and which the user of the machine as well as other persons can view through a transparent nearby panel or window 32. The transparency 31 is printed or otherwise prepared with the text and/or illustrations to be displayed.

Referring to FIGS. 2, 3, 4, and 4A, the internal support frame 12 of the machine 10 provides structural integrity to the cabinet 11 and support for the cleaning mechanisms 13 and 14. It includes a rear support frame 33 having two rear legs **34*a* and 34*b* and a top crossbar 35 and a front support frame 36 having two front legs 37*a* and 37*b* and a top crossbar 38. The four legs are elongate structural members, e.g., angle irons in cross-section, and they support a base plate 39** which extends between and is suitably mounted to their lower portions. These various frame components are suitably joined to one another at the respective joints, as by welding.

The base plate 39 of the internal support frame 12 supports the shoe cleaning apparatus 14 at one end below the opening 22. The shoe cleaning apparatus 14 includes the electric motor 24 suitably secured to a base 42 which is secured, in turn, to the base plate 39. This motor 24 drives a journaled brush shaft 43 mounted to the base 42 using two pillow block bearings **44*a* and 44*b* and two L-shaped mounting brackets 45*a* and 45*b*. The motor 24 is a conventional universal-type motor used to drive the shaft 43. It has an output shaft with a pulley 46 mounted to it. This pulley, a belt 47 (See FIG. 2), and a pulley 48 secured to the end of the brush shaft 43 transmit the power of the motor 24 to the shaft 43, turning the shaft 43 and four circular, nylon brushes 51 (See FIG. 4A) secured to the shaft 43. The nylon brushes 51 are sized and spaced to freely fit through four corresponding openings 52 in the bottom of a shoe housing 53. This housing 53 is a box-like structure disposed over the shoe cleaning apparatus 14 and around the opening 22 in the cabinet 11. It defines a cavity 54 in the cabinet 11 into which the user of the machine 10 inserts his or her shoe through the opening 22** for cleaning.

The base plate 39 also supports a vertical partition 55 disposed between support frames 33 and 36 at the middle of the base plate 39. This partition 55 divides the inside of the cabinet 11 in two and provides support for the ball cleaning apparatus 13 disposed beneath the opening 20 in the housing 11.

The ball cleaning apparatus 13 includes the electric motor 23 secured to a front panel 56 of the housing 11 a short distance above the base plate 21. The motor 23 is a conventional universal-type motor similar to the motor 24 used in the shoe cleaning apparatus 14. In operation, it drives a journaled buffer wheel shaft 57 mounted to a horizontal partition 58 by two pillow block bearings 61*a* and 61*b*. The vertical partition 55 and the two support frames 33 and 36 support the horizontal partition 58 a short distance below the opening 20. The motor 24 drives a pulley 62 mounted to its output shaft and adapted to drive a belt 63 that extends through an opening 64 in horizontal partition 58 and wraps around and drives a pulley 65 mounted securely to the journaled shaft 57 over and partially through the opening 64. When the pulley 65 turns, it drives the shaft 57 as well as a buffer wheel 66 mounted on the shaft 57 and disposed over and partially through an opening 67 in the horizontal partition 58. The openings 64 and 67 allow for the free rotation of the pulley 65 and the buffer wheel 66.

Figure 6:
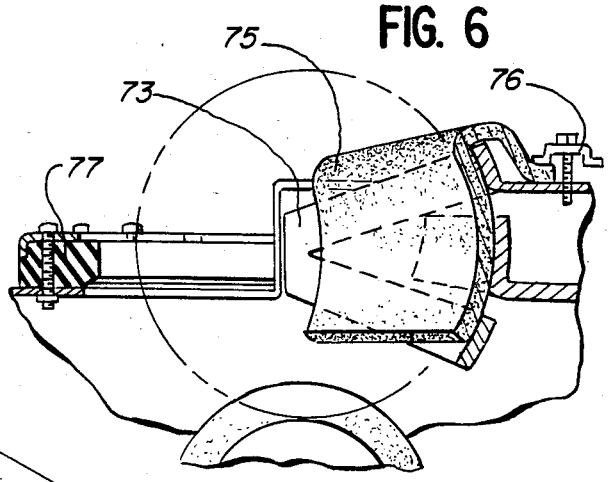
FIG. 6 is a sectional view taken along line 6—6 of FIG. 5.
Figure 5:
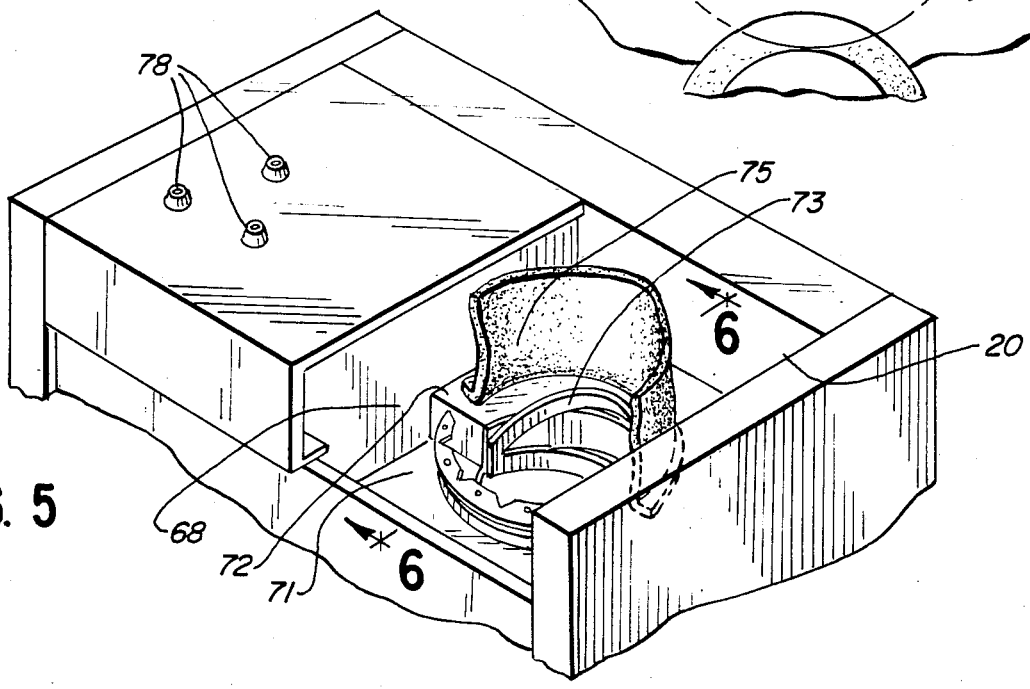
FIG. 5 is a partial perspective view of the top of the machine of FIG. 1 showing the ball receiving structure.

Referring to FIGS. 5 and 6, the cleaning machine 10 includes a ball cleaning and polishing compartment 68 disposed between the sliding door 21 that closes the opening 20 and a horizontal plate 71 disposed in the cabinet 11 and supported by and secured to the cross-bars 35 and 38. The compartment 68 contains a shelf 72 disposed above and secured to the horizontal plate 71 and adapted to support a cradle 73 around a portion of opening 74 (See FIG. 2) in the horizontal plate 71. The cradle 73 has a concave shape to match the contour of a bowling ball. It functions as a work holder for a flexible cleaning pad or cloth 75 with a coarse textured surface held in place over the cradle 73 by a number of clips 76. A bowling ball placed in the machine 10 for cleaning and polishing, thus, is supported by the cradle 73 and buffer 66 during cleaning. Opposite the cradle 73 around the opening 74, a semicircular bumper retainer 77, secured to the plate 71, functions as an opposed retainer for the bowling ball. This bumper retainer 77 and the cradle 73 form a receptacle at opening 74 for the bowling ball. The buffer wheel 66 located beneath the opening 74 acts as the bottom of this receptacle, buffing the bowling ball, and moving it against cleaning pad 75 which cleans the ball by removing foreign particles from its surface.

The machine 10 also includes three rubber bumpers 78 secured to the top of the cabinet 11 and arranged to retain a bowling ball placed on top of the cabinet 11.

In operating the machine 10, a user will place a bowling ball through the opening 20 in the cabinet 11 and into the compartment 68 between the band structure 73 and the bumper retainer 77. The user must then close the door 21 over the opening 20, closing switch D, and insert the appropriate token, coin or coins in the machines coin receiving mechanism 81 (See FIG. 1), closing the power circuit's coin-operated timer switch C. The power source will then drive the motor 23 and the ball cleaning mechanism 13 will operate to clean the ball.

To activate the shoe cleaning mechanism the user must push the spring-loaded push switch P and hold it closed, allowing the power source to activate the shoe cleaning mechanism 14. The user may then place a foot in opening 22 with the sole of his shoe on top of the rotating nylon brushes 51 to clean the shoe sole.

It will be seen that a machine has been provided which meets the aforestated requirements and objects.

While the applicant has shown and described only one embodiment, it will be understood, of course, that the invention is not limited to this embodiment since modifications of this embodiment and other embodiments will occur to those skilled in the art to which the invention pertains, particularly upon considering the foregoing teachings. It is therefore, contemplated by the appended claims to cover any such modifications and other embodiments as incorporate these features which constitute the essential features of this invention within the true spirit and scope of the following claims.

What is claimed is:

1. A machine for cleaning bowling balls and shoes, comprising: a housing having a first opening for receiving a bowling ball; a ball cleaning assembly disposed in said housing adjacent said first opening and accessible therethrough, said ball cleaning assembly including a first drive shaft, at least one buffer wheel secured to said shaft, and a first motor to turn said first drive shaft; first power supply means connected to said first motor and including a first control switch therefor; said housing having a second opening; a shoe cleaning assembly disposed in said housing adjacent said second opening and accessible therethrough, said shoe cleaning assembly including a second drive shaft, at least one shoe cleaning element secured to said second drive shaft, and a second motor to turn said second drive shaft; second power supply means connected to said second motor and to said first power supply means for actuation of said second motor only when said first switch is closed and including a second control switch for further controlling the application of power to said second motor whereby both said first and said second switches must be closed to activate said second motor so that said shoe cleaning assembly can be activated only when said ball cleaning assembly is in operation.

2. A machine as in claim 1 including a displaceable cover selectively closeable over said first opening, and a third switch in said first power supply means, said third switch closing upon displacement of said cover to the closed-cover position.

3. A machine as in claim 2, wherein said displaceable cover is a sliding door.

4. A machine as in claim 1, wherein said second control switch includes a spring-loaded switch and a button, said switch adapted to be closed only when pressure is maintained on said button.

5. A machine as in claim 1, wherein said ball cleaning assembly includes at least one cleaning pad disposed in said machine to co-act with said buffer wheel in supporting and cleaning said bowling ball.

6. A machine as in claim 5, wherein said cleaning pad has a coarse textured surface.

7. A machine as in claim 1, 2, 3, 4, 5 or 6, wherein said first control switch is a coin-operated timer switch.

8. A machine for simultaneously cleaning a bowling ball and a user's shoe, said machine comprising: a housing having a first opening in an upper side portion for conveniently receiving a bowling ball of a user while such user is standing adjacent said housing; power operated ball cleaning means disposed within said housing adjacent said first opening for receiving, cleaning and polishing said ball, said ball cleaning means including at least one buffer wheel, at least one cleaning pad, and a cradle for supporting said cleaning pad, said cradle having a concave configuration to receive and support said bowling ball and said cleaning pad substantially covering said cradle and extending above and below the center of, and around a substantial portion of said bowling ball when said ball is disposed in said ball cleaning means; cradle, pad, and buffer wheel co-acting to support, clean and polish said bowling ball, whereby rotation of the buffer wheel rotates the ball and moves it against the cleaning pad to clean and polish it; and shoe cleaning means disposed within a lower portion of said housing and accessible for convenient positioning of a foot of a user thereon while such user is standing adjacent said housing for insertion and retrieval of a ball in said first opening for cleaning by said ball cleaning means.

9. A machine as in claim 8, wherein said housing has a top side, said first opening being provided in said top side.

10. A machine as in claim 9, wherein said housing includes a display fixture for displaying promotional or educational material before a user while so disposed adjacent said machine.

11. A machine as in claim 10, wherein said display fixture is disposed on said top side of said housing.

12. A machine as in claim 8, 9, 10 or 11, wherein said housing includes a second opening disposed adjacent said shoe cleaning means so that said shoe cleaning means is accessible therethrough.

* * * * *

UNITED STATES PATENT AND TRADEMARK OFFICE

CERTIFICATE OF CORRECTION

PATENT NO. : 4,567,618

DATED : Feb. 4, 1986

INVENTOR(S) : Remo N. Picchietti, Sr.

It is certified that error appears in the above-identified patent and that said Letters Patent is hereby corrected as shown below:

Column 2, line 26, "mechanism" shoud be --mechanisms--.

Column 4, line 21, "wll" should be --will--.

Column 7, line 7, after "means;" insert --said--.

Signed and Sealed this

*Second* Day of *September 1986*

[SEAL]

*Attest:*

DONALD J. QUIGG

*Attesting Officer*

*Commissioner of Patents and Trademarks*